US005582407A

United States Patent [19]

Sorenson

[11] Patent Number: 5,582,407

[45] Date of Patent: Dec. 10, 1996

[54] GOLF SWING TRAINER

[76] Inventor: James W. Sorenson, 1412 E. 37th St. S., Tulsa, Okla. 74467

[21] Appl. No.: 509,541

[22] Filed: Jul. 31, 1995

[51] Int. Cl.[6] ..... A63B 69/36

[52] U.S. Cl. ..... 473/256; 482/109

[58] Field of Search ..... 273/193 A, 186.2; 434/252; 482/109

[56] References Cited

U.S. PATENT DOCUMENTS

| | | | |
|---|---|---|---|
| 2,396,408 | 3/1946 | Benecke | 272/84 |
| 2,462,955 | 3/1949 | Glancey | 273/35 |
| 2,470,816 | 5/1949 | Harvey | 482/109 |
| 2,532,646 | 12/1950 | Severin | 273/193 RX |
| 3,231,281 | 1/1966 | Wallo | 273/193 A |
| 3,743,297 | 7/1973 | Dennis | 273/193 A |
| 4,444,396 | 4/1984 | Wendt | 273/193 |
| 4,953,868 | 9/1990 | Thompson | 273/186.2 |
| 4,982,963 | 1/1991 | Fazio et al. | 273/186 A |
| 5,026,063 | 6/1991 | Rhodes | 273/186 A |
| 5,083,790 | 1/1992 | Wheatley | 273/193 A |
| 5,135,228 | 8/1992 | Hawkins et al. | 273/186.2 |
| 5,249,803 | 10/1993 | Griffin | 273/193 A |
| 5,330,190 | 7/1994 | Oakley, Jr. | 273/186.2 |
| 5,330,193 | 7/1994 | Ijiri | 273/193 A |
| 5,405,138 | 4/1995 | Duran | 273/186.2 |

*Primary Examiner*—George J. Marlo
*Attorney, Agent, or Firm*—Frank J. Catalano; Scott R. Zingerman

[57] ABSTRACT

A golf swing trainer employs a solid steel shaft homogeneously weighted throughout its entire length. One end of the shaft is fitted with a standard golf club grip and the other end of the shaft is fitted with a rubber tip to afford some protection for walls, floors and furnishings should the golfer elect to use the device indoors. A golf club head can be used instead of this tip for visual or psychological reasons. The top of the shaft bears a straight line indicia as a club face reference. The homogeneously weighted shaft so closely positions the center of gravity of the training device to the center of gravity of an actual golf club on a correct swing path as to break down incorrect muscle memory and simultaneously develop the muscle memory appropriate to the correct golf swing.

Having programmed the muscles to repeat the proper motion by use of the trainer, the golfer is able to allow muscle memory to cause a repetition of the proper swing rather than mentally processing the components of the swing as the swing is made, a process most golfers recognize to be a futile exercise leading to disaster.

10 Claims, 7 Drawing Sheets

GOLF SWING TRAINER

BACKGROUND OF THE INVENTION

This invention relates generally to athletic equipment and more particularly concerns golf swing practice equipment.

There are many golf swing trainers in the marketplace which claim tremendous results through correct use on a consistent basis. While most of them have some merit and offer some benefits, they all can be generally categorized by one or more counterproductive deficiencies.

One category includes trainers that are unweighted in comparison to actual golf clubs. Since these trainers are not weighted, they neither communicate to the muscles of the golfer in such a way as to break down muscle tension and old muscle habits, nor develop the proper muscle memory needed to produce a correct golf swing. Furthermore, while some of these unweighted devices feel good to swing, they generally cause the golfer to swing the club over the top of the ball.

Another category includes trainers which are improperly weighted, such as by use of oversized or weighted clubheads, increased weights where the clubhead would otherwise be located and weight mechanisms that are hinged to the clubhead end of the shaft. These devices use a variety of straight or bent shafts. While these weighted devices will change muscle memory, since they are improperly weighted they conform it to an improper golf swing. They generally cause the club to be swung on an incorrect path, encourage the golfer to release the club too early and come over the top of the ball or cause the swing to be excessively wristy which also takes the club shaft off the correct path.

A third category does not involve a golf club substitute at all, but employs swing guidance mechanisms such as hoops, tracks, belts and the like designed to force the golfer to swing an actual golf club or trainer on a proper swing path. Such devices are generally quite complicated and require much time in setting up for the unique physical characteristics of each individual golf student. Since they do not involve weighted mechanisms, they do not break down old incorrect muscle memory or build new correct muscle memory. Furthermore, these swing guidance mechanisms are generally based on the false premise that a golf swing takes place in a single plane. The golf swing is a bi-planar three-dimensional motion which known guidance mechanisms do not replicate.

It is, therefore, an object of this invention to provide a swing trainer that is weighted so as to break down muscle tension and old muscle habits. It is a further object of this invention to provide a golf swing trainer which is properly weighted to develop the muscle memory appropriate to produce the correct golf swing. Another object of this invention is to provide a golf swing trainer that requires no set up for a training session. A further object of this invention is to provide a golf swing trainer that readily fits in a golf bag with the golfer's other equipment. Yet another object of this invention is to provide a golf swing trainer that has no moving parts and requires no assembly. And it is an object of this invention to provide a golf swing trainer that can be used anywhere, indoors or outdoors, as a trainer and also as a warm-up tool.

SUMMARY OF THE INVENTION

In accordance with the invention, a golf swing trainer is provided which consists of a solid steel shaft homogeneously weighted throughout its entire length. One end of the shaft is fitted with a standard golf club grip and the other end of the shaft is fitted with a rubber tip to afford some protection for walls, floors and furnishings should the golfer elect to use the device indoors. Preferably, the surface of the shaft bears a longitudinal straight line indicia which provides a visual guide to the golfer as a club face reference. The homogeneously weighted shaft so closely positions the center of gravity of the training device to the center of gravity of an actual golf club on a correct swing path as to break down incorrect muscle memory and simultaneously develop the muscle memory appropriate to the correct golf swing.

Typically, the trainer will be in the range of 33 to 36 inches long and ⅝ or ½ inch in diameter, the particular length and diameter being chosen to accommodate the size and strength of the golfer. When the golfer has swung the trainer several times, the actual golf club will feel much lighter and easier to swing and unhealthy muscle tension, which is so destructive to a proper swing, will begin to disappear. In addition, the actual golf club will travel along the same path that the trainer followed because the golfer's muscles will repeat what they have learned in swinging the properly weighted trainer. Having programmed the muscles to repeat the proper motion by use of the trainer, the golfer is able to allow muscle memory to cause a repetition of the proper swing rather than mentally processing the components of the swing as the swing is made, a process most golfers recognize to be a futile exercise leading to disaster.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figures 1, 2, 3, 4:
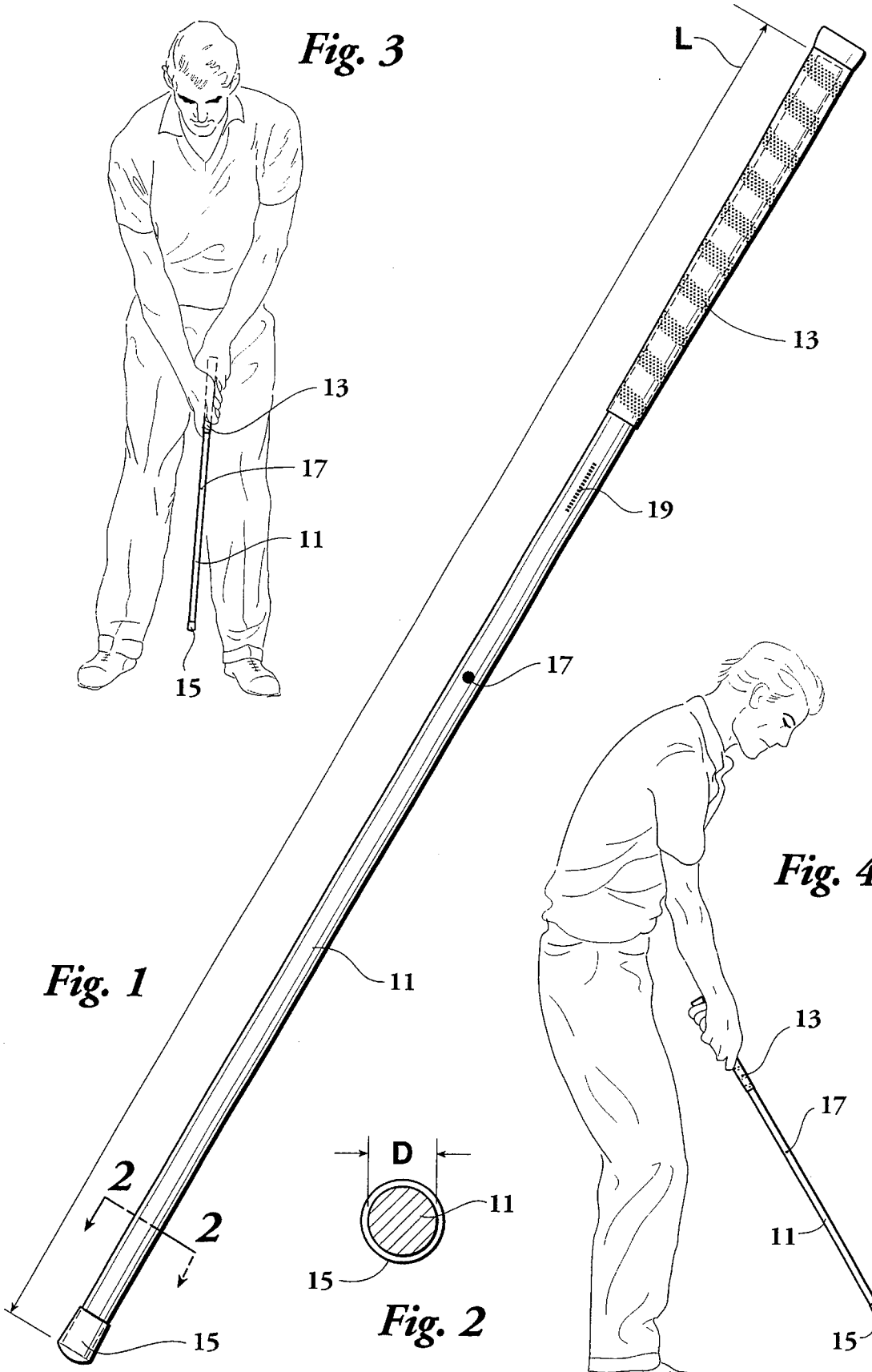
FIG. 1 is a front elevation view of a preferred embodiment of the swing trainer.
FIG. 2 is a cross-sectional view taken along the line 2—2 of FIG. 1.
FIG. 3 is a front elevation view of a golfer holding the swing trainer of FIG. 1 in an address position.
FIG. 4 is a side elevation view of the position of FIG. 3.

Turning first to FIGS. 1 and 2, a preferred embodiment of the swing trainer consists of a shaft 11 having a typical golf grip 13 mounted on its upper end and a rubber tip 15 mounted on its lower end. As can best be seen in FIG. 2, the shaft 11 is made of solid round stock, preferably steel rod of preferably ⅝ or ½ inch diameter D depending on the strength of the golfer. Given the substantially homogeneous distribution of weight along the steel shaft 11, the center of gravity 17 of the swing trainer is minimally affected by the weight of the lighter grip 13 and tip 15 added to its ends. Consequently, the center of gravity 17 of the constant diameter swing trainer will essentially be the midpoint of the length L of the shaft 11. Preferably, an indicia 19 is provided on the surface of the shaft 11 just below the grip 13 to provide the golfer with a visual reference in lieu of the absent club head to facilitate learning of proper positioning of the hands in gripping the trainer. The indicia 19 may be a decal having a visible line or an etched marking or the like extending longitudinally along the shaft 11.

Figure 5:
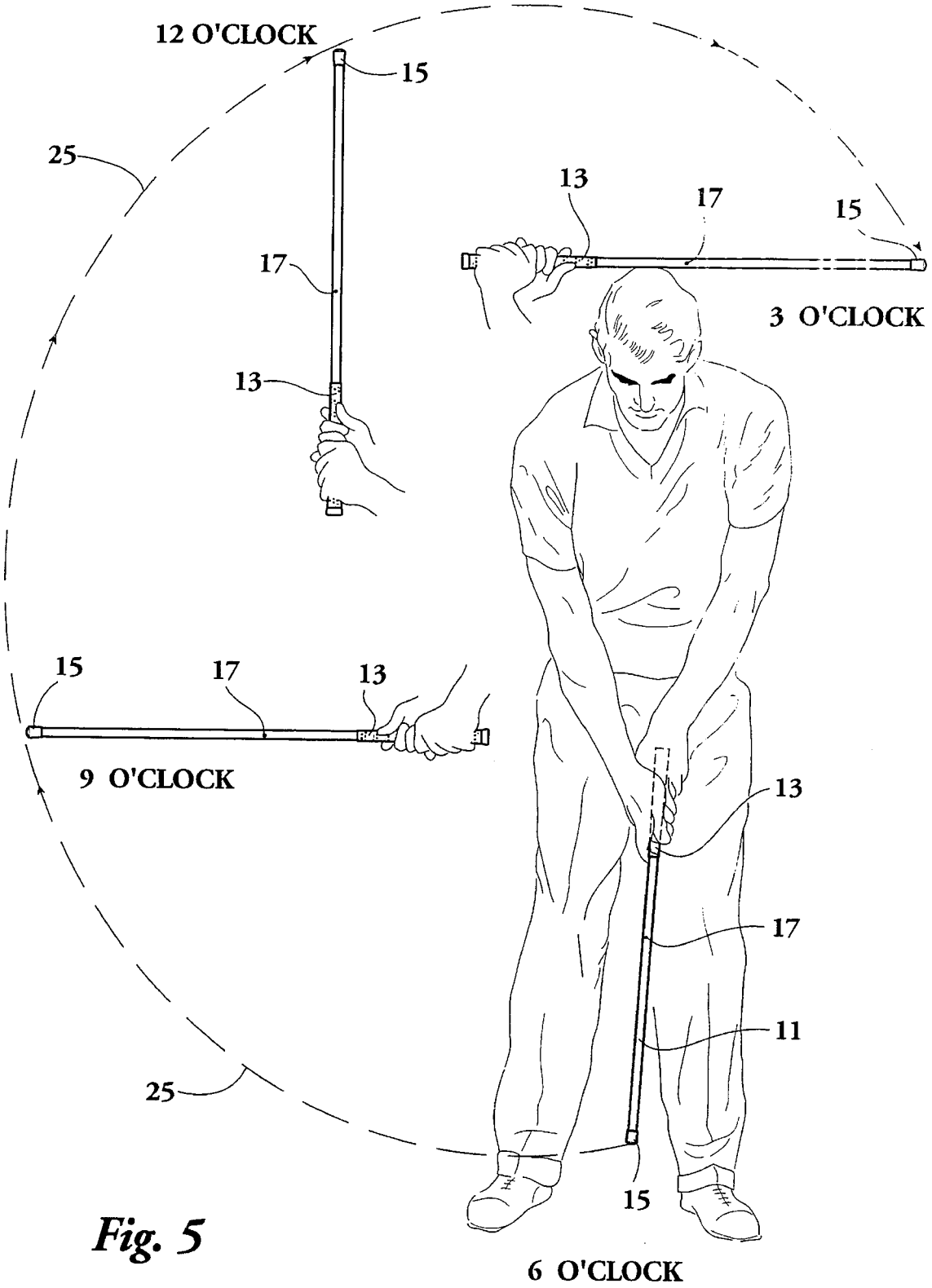
FIG. 5 is a sequential front elevation view of a golfer swinging the swing trainer of FIG. 1 from the address position back to the top of the swing.
Figure 6:
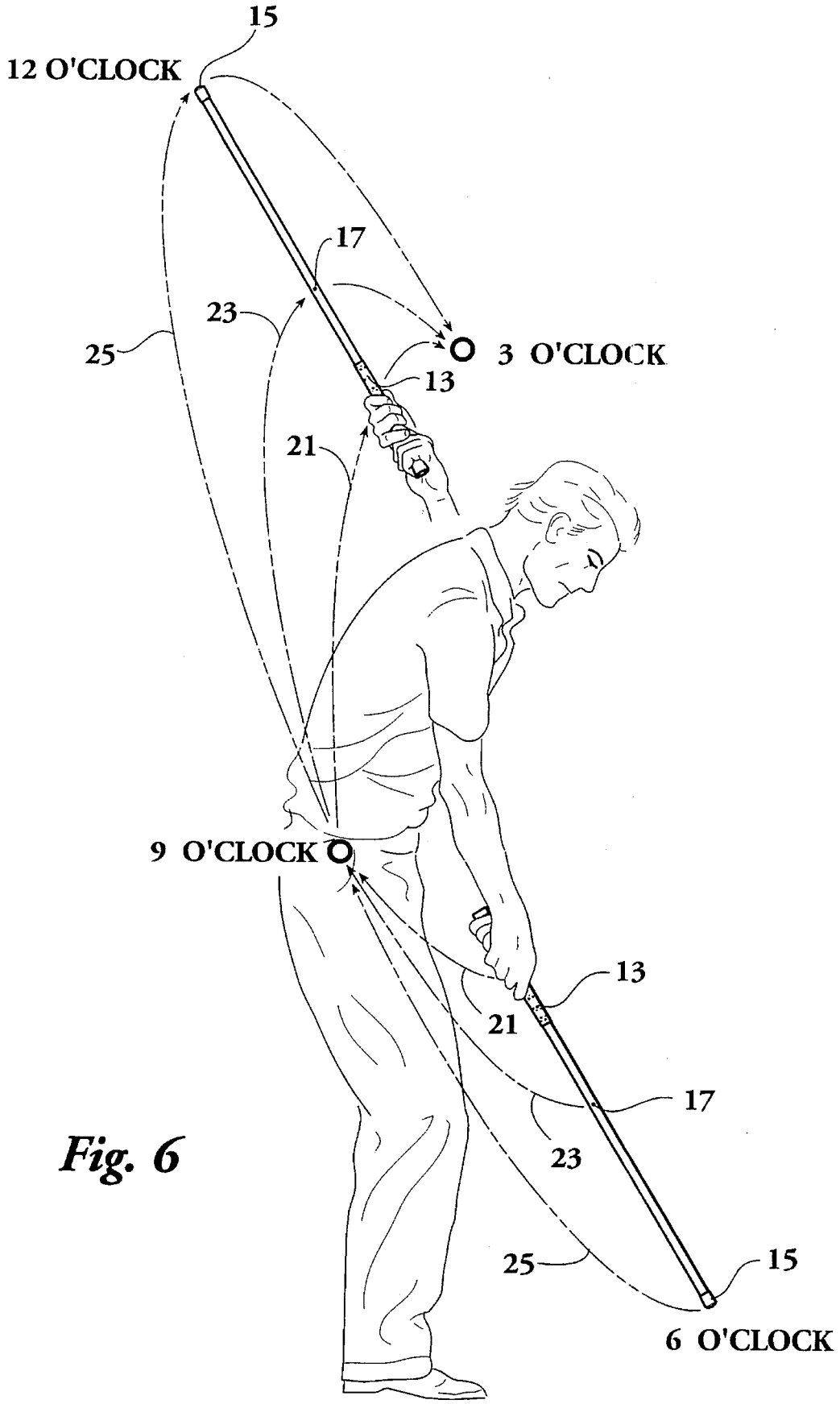
FIG. 6 is a side elevation view of the sequence of FIG. 5.
Figure 7:
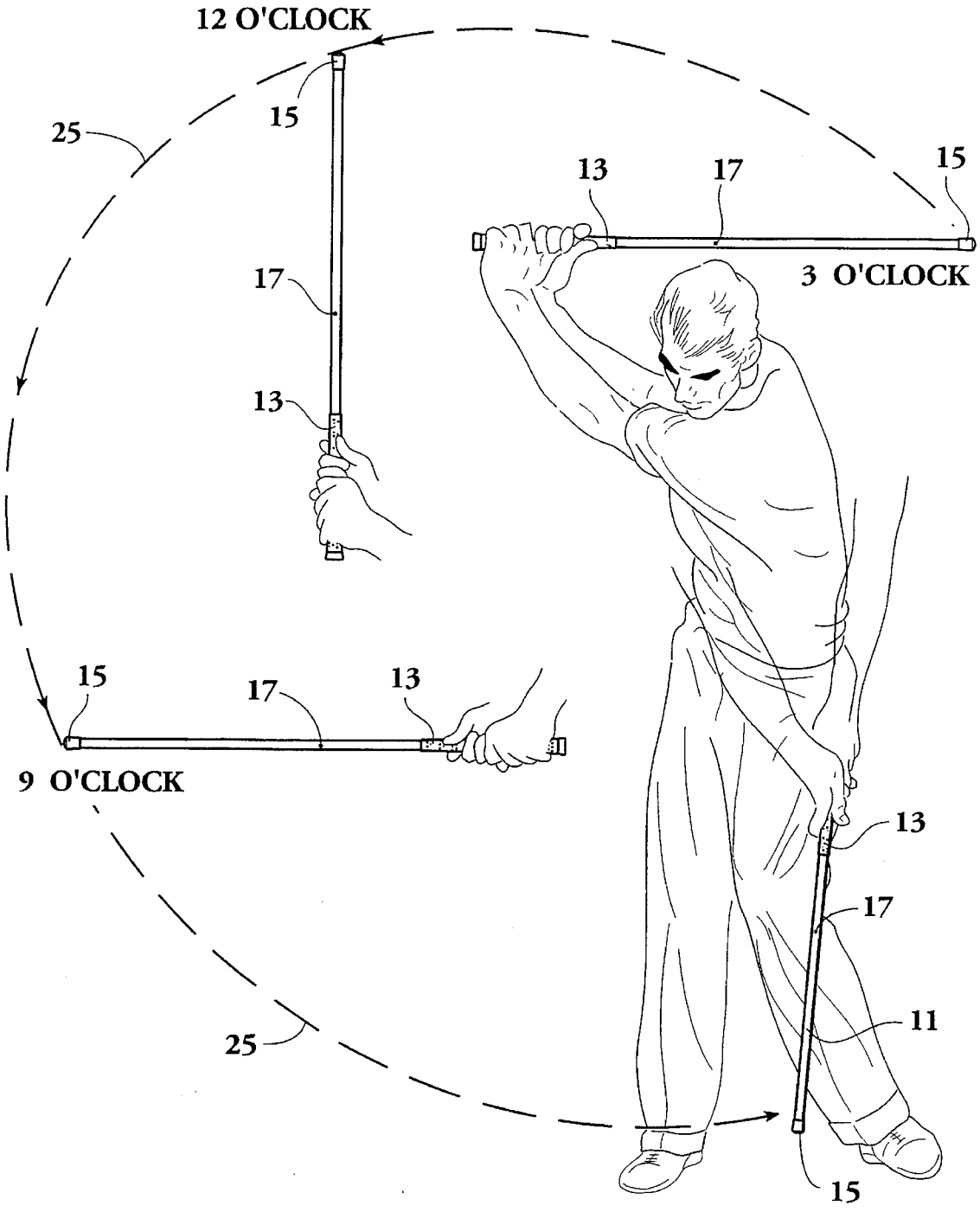
FIG. 7 is a sequential front elevation view of a golfer swinging the swing trainer of FIG. 1 from the top of the swing down to the point of impact.
Figure 8:
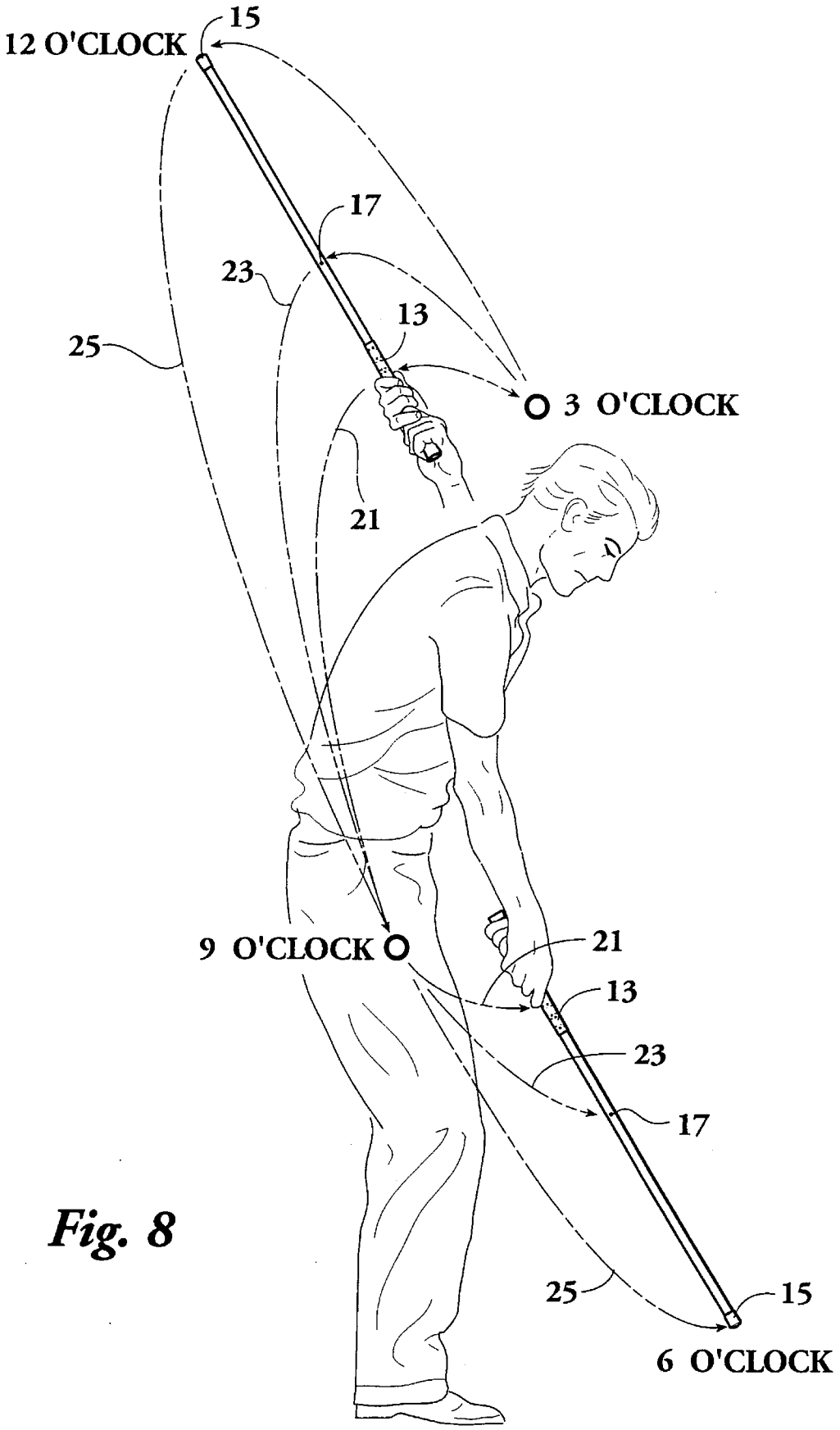
FIG. 8 is a side elevation view illustrating the sequence of FIG. 8.
Figure 9:
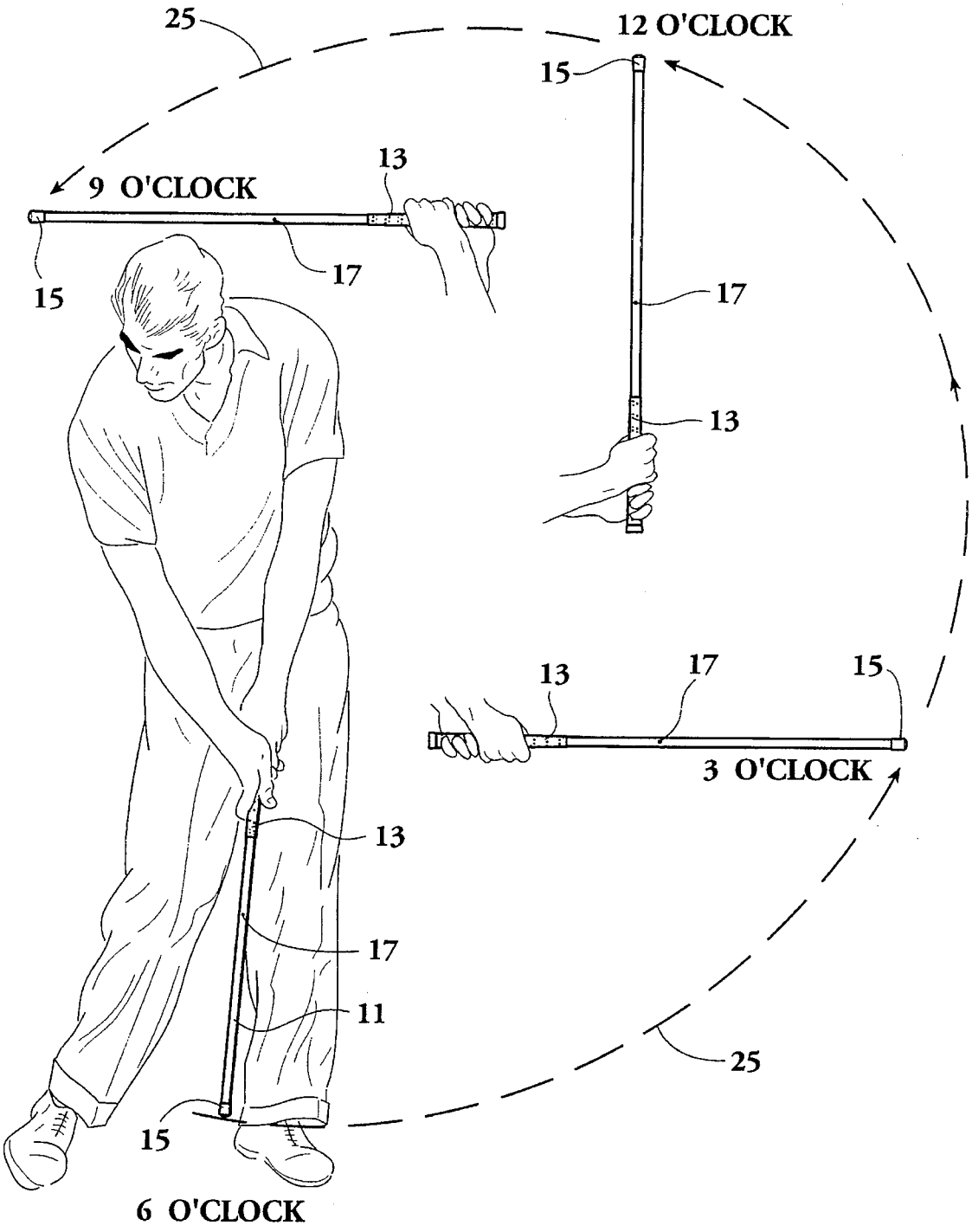
FIG. 9 is a sequential front elevation view of a golfer swinging the swing trainer of FIG. 1 from the point of impact position up to the finish point of the golf swing.
Figure 10:
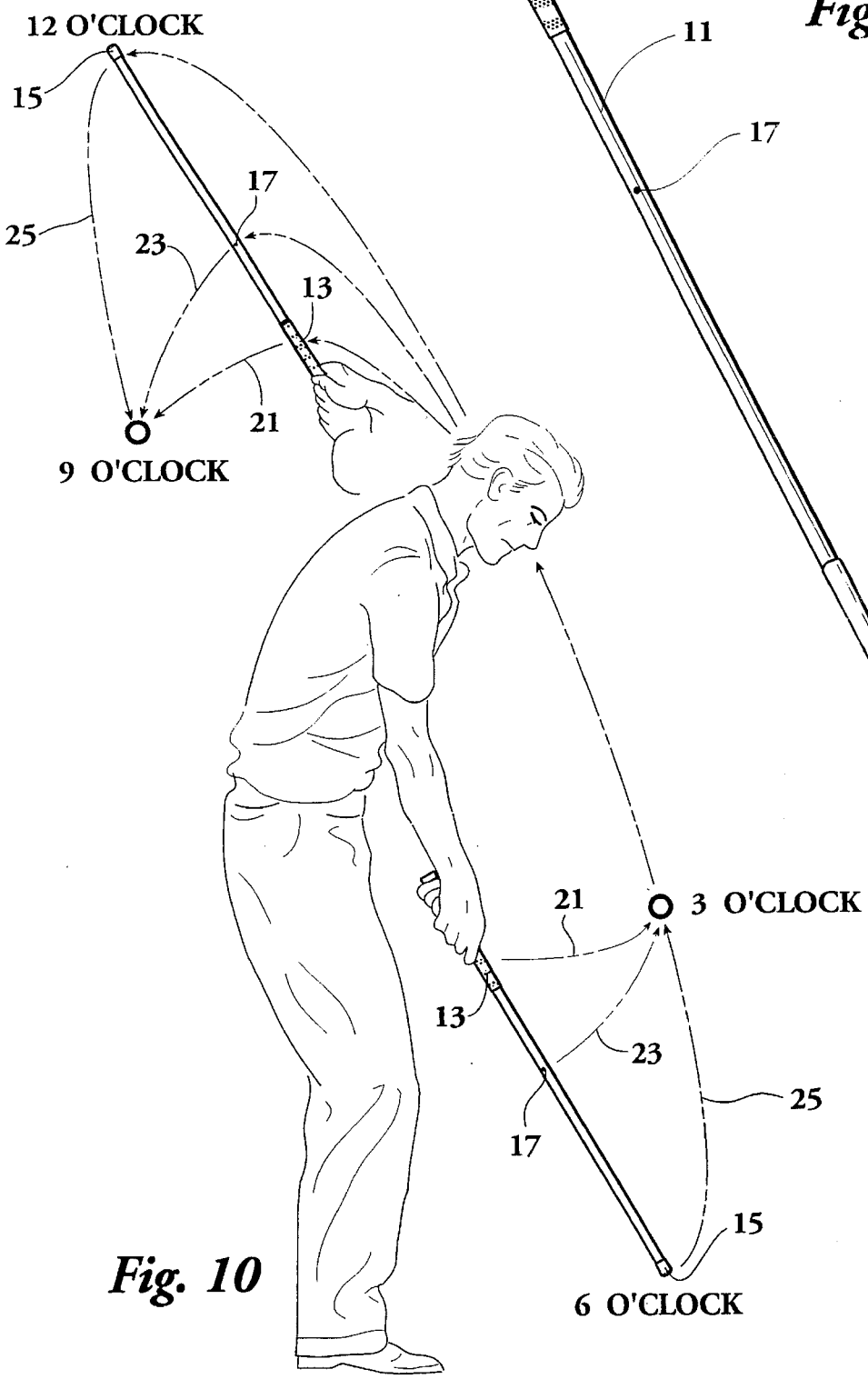
FIG. 10 is a side elevation view illustrating the sequence of FIG. 9.

Turning now to FIGS. 5 through 10, the function of the swing trainer in building appropriate muscle function to produce a proper golf swing can be understood. In these Figures, the motion of the trainer in a correct golf swing is broken down into three major segments. FIGS. 5 and 6 illustrate the back swing in which the trainer moves from the address position to the top of the swing. FIGS. 7 and 8 illustrate the downswing in which the trainer moves from the top of the swing to the point of impact with the ball. FIGS. 9 and 10 illustrate the follow-through in which the trainer moves from the point of impact to the finish position. Looking generally at FIGS. 5 through 10 taken together, each of the major swing segments is seen to consist of a 45 minute clock-like rotation. Each 45 minute segment is broken down further into three 15 minute segments, the backswing of FIGS. 5 and 6 extending from 6:00 o'clock through 9:00, 12:00 and 3:00 o'clock, the downswing of FIGS. 7 and 8 extending from 3:00 o'clock through 12:00, 9:00 and 6:00 o'clock and the follow-through of FIGS. 9 and 10 extending from 6:00 o'clock through 3:00, 12:00 and 9:00 o'clock.

The concept of the golf swing being bi-planar is best illustrated in FIGS. 6, 8 and 10 which show that in the 6:00 and 12:00 o'clock positions, while the shaft 11 lies in parallel planes, the shaft 11 is not in the same plane at 12:00 o'clock as it was at 6:00 o'clock. These Figures further illustrate that at the 9:00 and 3:00 o'clock conditions, the shaft 11 is not only horizontal but is also parallel to the intended line of flight of the ball. Thus, as is best seen in FIGS. 6, 8 and 10, at the 9:00 and 3:00 o'clock positions, the clubhead end of the shaft 11, the center of gravity 17 of the shaft 11 and the grip 13 lie only momentarily in lines which are parallel to the planes defined by the shaft 11 at 6:00 and 12:00 o'clock and the intended trajectory of the ball. At all other points in the swing, the paths 21, 23, and 25 of the grip 13, the center of gravity 17 and the clubhead end of the shaft 11, respectively, are in different planar relationships relative to the intended trajectory. It is readily apparent that during the swing the hands are not moving on the same trajectory as the head end of the shaft 11.

The variable nature of the golf swing is further apparent from FIGS. 5, 7 and 9 which show that the motion of the head end of the shaft 11 is not circular. This is because the backswing motion of FIG. 5 from 6:00 to 9:00 o'clock primarily involves rotation of the left forearm and bending of the right elbow, from 9:00 to 12:00 o'clock more predominantly involves rotation of the shoulders and from 12:00 to 3:00 o'clock more predominantly involves the cocking of the wrists in an axe-like chopping motion. Since the center of motion is constantly changing, a circular path cannot be achieved. In the downswing motion of FIG. 7, from 3:00 to 12:00 o'clock predominantly the hands drop and uncock in the chopping motion, from 12:00 to 9:00 o'clock predominately the shoulders rotate and from the 9:00 to 6:00 o'clock positions predominately the left forearm rotates back to its square condition accompanied by the straightening of the right elbow. In the follow-through of FIG. 9, motion from 6:00 to 3:00 o'clock predominantly involves the right forearm rotating and the left elbow bending, from 3:00 to 12:00 o'clock predominantly involves rotation of the shoulders and from 12:00 to 3:00 o'clock predominantly involves a chopping motion of the wrists again.

The analysis of FIGS. 5 through 10 treats several things about the use of the swing trainer. The more the swing weight is concentrated at the club head end of the shaft 11, the more the inertia of the weight draws the hands out of the correct swing motion and improperly trains the muscle memory. On the other hand, the closer the swing weight is located to the grip 13, the less assistance the weight would be in training the path of the swing. However, when the swing weight is focused at the center 17 of the shaft 11, as the golfer at first mentally causes the club head to travel along the appropriate path, the swing weight at the center 17 of the shaft 11 in a sense operates as a fulcrum helping the hands to be in the right trajectory. As the golfer correctly repeats individual segments of the swing and the clubhead travels along its proper swing path, the swing weight focused at the center 17 of the shaft 11 provides the force necessary to break down old muscle responses and train the new muscle responses that produce the appropriate swing path. In other words, the length of stock is so substantially or sufficiently heavier than a typical golf club that repeated swings of the trainer establishes a muscle memory of the path of the swing, breaking down the incorrect muscle memory and building the correct muscle memory of the path of the swing.

Figure 11:
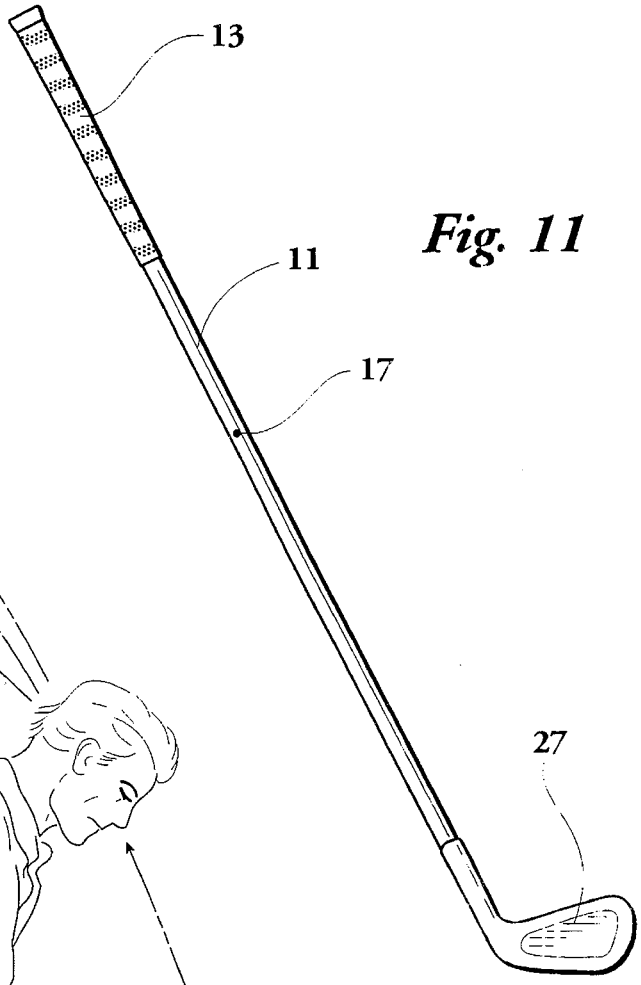
FIG. 11 is a rear elevation view of another embodiment of the swing trainer.

Some golfers have difficulty psychologically in associating their swing trainer swing to their actual golf club swing. To overcome this psychological difficulty, one preferred embodiment of the swing trainer may incorporate a clubhead 27 at the end of the shaft 11 as is shown in FIG. 11. However, the addition of the clubhead 27 tends to alter the center of gravity 17 of the trainer in more than a negligible amount. It is therefore desirable that the clubhead 27 be kept as light as possible. Furthermore, if a ⅝ or ½ inch stock is used for the shaft 11, the clubhead end of the shaft must be adapted to fit a standard ⅜" golf club head connector or, in the alternative, a ⅜ inch stock could be used and the grip end of the shaft 11 adapted to accommodate the standard grip 13.

While some specific preferred dimensions have been disclosed for shaft length, diameter and material, any length, diameter and material could be used depending on the height and strength of the golfer.

Thus, it is apparent that there has been provided, in accordance with the invention, a golf swing trainer that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A golf swing trainer consisting essentially of a golf grip fixed about one end of a length of round stock which is solid throughout it length and cross-section, sold round stock, said trainer having a center of gravity substantially centered at a midpoint of a longitudinal axis of said length of round stock, and the weight of said round stock being heavier than a typical golf club so that repeated swings of the trainer establishes a muscle memory of the path of the swing, breaking down the incorrect muscle memory and building the correct muscle memory of the path of the swing.

2. A trainer according to claim 1, said stock having a constant diameter.

3. A trainer according to claim 1, said stock having a substantially homogeneous weight distribution along said length.

4. A trainer according to claim 1, said stock being made of steel.

5. A trainer according to claim 1, said stock having a diameter of ⅝".

6. A trainer according to claim 1, said stock having a diameter of ½".

7. A trainer according to claim 1, said length being approximately 33" to 36".

8. A trainer according to claim 1 further comprising a soft tip fixed to another end of said length of stock.

9. A trainer according to claim 1 further comprising a golf club head fixed to another end of said length of stock.

10. A trainer according to claim 1 further comprising an indicia longitudinally aligned along a surface of said length of stock below said golf grip.

* * * * *

UNITED STATES PATENT AND TRADEMARK OFFICE

CERTIFICATE OF CORRECTION

PATENT NO. : 5,582,407
DATED : December 10, 1996
INVENTOR(S) : James W. Sorenson

It is certified that error appears in the above-indentified patent and that said Letters Patent is hereby corrected as shown below:

Column 5, line 6, delete "sold round stock,".

Signed and Sealed this

Thirtieth Day of September, 1997

*Attest:*

*Attesting Officer*

Bruce Lehman

BRUCE LEHMAN

*Commissioner of Patents and Trademarks*